United States Patent [19]

Telling

[11] 4,213,384

[45] Jul. 22, 1980

[54] COMPACTING APPARATUS

[75] Inventor: Edward F. Telling, Worthing, England

[73] Assignee: Trewhella Bros. (UK) Ltd., United Kingdom

[21] Appl. No.: 927,531

[22] Filed: Jul. 24, 1978

[30] Foreign Application Priority Data

| | | | |
|---|---|---|---|
| Jul. 26, 1977 | [GB] | United Kingdom | 31402/77 |
| Oct. 14, 1977 | [GB] | United Kingdom | 42925/77 |
| Feb. 3, 1978 | [GB] | United Kingdom | 4530/78 |
| Feb. 14, 1978 | [GB] | United Kingdom | 5764/78 |
| Apr. 6, 1978 | [GB] | United Kingdom | 13597/78 |
| Apr. 18, 1978 | [GB] | United Kingdom | 15102/78 |

[51] Int. Cl.[2] ..... B30B 15/08; B30B 15/30; B30B 9/32

[52] U.S. Cl. ..... 100/74; 100/DIG. 2; 100/98 R; 100/215; 100/218; 100/209; 100/245; 100/295; 222/87; 241/99

[58] Field of Search ..... 100/DIG. 2, 218, 98 R, 100/98 A, 295, 108, 116, 215, 74, 209, 245; 241/99; 222/87, 82, 88

[56] References Cited

U.S. PATENT DOCUMENTS

| | | | |
|---|---|---|---|
| 1,998,263 | 4/1935 | Townsend | 222/87 |
| 2,139,143 | 12/1938 | Wiswell | 222/87 |
| 2,346,561 | 4/1944 | Delay | 100/108 |
| 2,654,308 | 10/1953 | Millard | 100/98 A |
| 2,737,995 | 3/1956 | Jennings | 100/DIG. 2 |
| 3,024,720 | 3/1962 | Welsh | 100/DIG. 2 |
| 3,993,221 | 11/1976 | Boynton | 100/98 R |

FOREIGN PATENT DOCUMENTS 533296 9/1955 Italy .

*Primary Examiner*—Billy J. Wilhite

*Attorney, Agent, or Firm*—Roylance, Abrams, Berdo & Farley

[57] ABSTRACT

Compacting apparatus comprising a first compacting plate and a second compacting plate arranged for linear, reciprocating movement relative to the first compacting plate. Arranged between the plates in the neighborhood of one of said plates is a free-fall aperture, such that a compacted object is able to fall freely, through gravity, from said apparatus subsequent to completing a compacting stroke.

14 Claims, 8 Drawing Figures

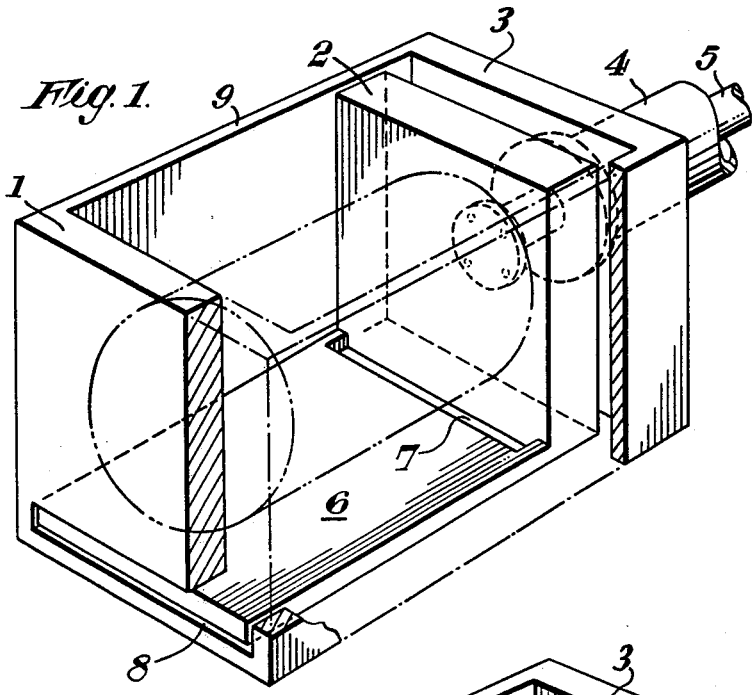
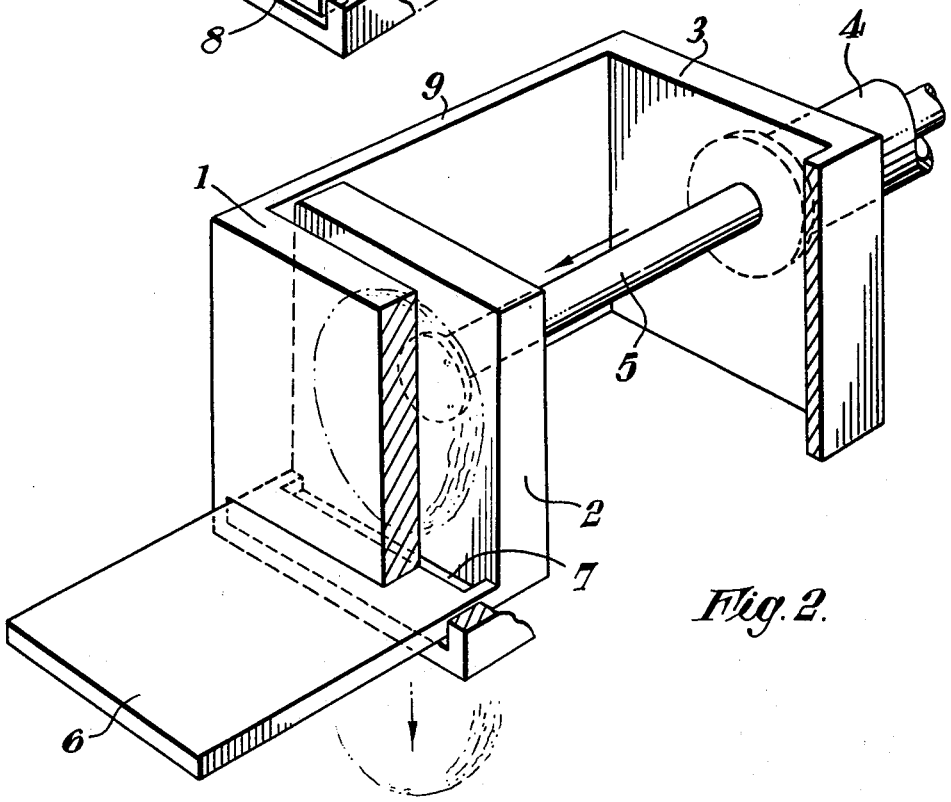
Fig. 2.

1c
2c
3c
4c
5c
6c
7c
8c
9c
51
52
52
53

COMPACTING APPARATUS

The present invention relates to compacting apparatus. The term compacting apparatus as used here and in the following is meant also to include crushing apparatus such as those used to break and crush bottles and other brittle containers.

An object of the present invention is to provide a compacting apparatus in which objects, such as tin cans, bottles and like waste, can be compacted or crushed in an easy and efficient manner.

A further object of the present invention is to provide such a compacting apparatus in which a compacted object or objects is or are permitted to fall freely from the apparatus.

A further object is to provide such compacting apparatus in which the contents of a liquid-filled container can be emptied therefrom during a compacting operation.

The compacting apparatus of the present invention consists in at least one first compacting plate; at least one second compacting plate arranged for reciprocating movement relative said at least one first compacting plate; means for moving one of said plates relative to the other; and free-fall means arranged adjacent one of said plates to permit a compacted object to fall freely from said apparatus. The means for causing said relative movement of the first and second compacting plates may comprise any suitable, reciprocating prime mover, such as piston and cylinder arrangement or a worm screw, arranged to co-operate with a respective one of said plates for movement thereof along a compacting path.

For the purpose of supporting an object to be crushed or compacted between the mutually opposing faces of the first and second compacting plates, the plates may be arranged to co-operate with a floor means which will define an aperture through which a compacted object is able to fall freely, e.g. into a container placed beneath said aperture.

Conveniently, feed means are provided for feeding objects into the compacting space formed between the movable plate and the stationary plate in the starting positions of said plates. This object-feeding means may have the form of a hopper arrangement, with the objects being fed to the apparatus in a selected time sequence corresponding to the speed at which the movable plate carries out a compacting operation, or may be arranged to fall freely from said hopper into said space, in which case the movable plate is provided with a tail or support surface extending outwardly of and at an angle to said movable plate, an object falling from the hopper being held by the tail until the movable plate is returned to its starting position, whereupon said object is able to fall into the compacting space between said plates. It will be understood that the tail plate can be provided with means for aligning the object in a given relationship relative to the direction of movement of said movable plate.

When the compacting apparatus is to be used to crush bottles or other brittle objects, one of the plates may have arranged on the surface thereof facing the other of said plates a plurality of pegs which, during a crushing operation are arranged to be received in respective ones of a plurality of through-holes arranged in the other of said plates. In this way, powdered material, such as powdered glass is prevented from building-up adjacent the compacting plates and thus impairing the efficiency of the apparatus.

When the objects to be compacted are tin cans, for example, one of the two mutually opposing surfaces of said plates may be provided with an axially displaceable can-piercing device. A compacting apparatus thus constructed can be used to pierce a liquid-filled can and to drain it of its contents as the can is being compacted. The piercing device is arranged such that it will be automatically withdrawn from the compacted can just prior to the termination of a compacting operation, so that the compacted can is able to fall through said free-fall aperture.

The described compacting apparatus may be joined to a similar compacting apparatus to form a so-called tandem compacting apparatus. In this case the compacting apparatus may comprise at least one first compacting plate and at least one second compacting plate attached to and spaced from said at least one first compacting plate; at least one third compacting plate arranged intermediately of said first and said second compacting plates; said at least one first compaction plate and said at least one second compaction plate being arranged for rectilinear movement relative said at least one third plate; means for providing said rectilinear movement; and a free-fall aperture adjacent each of said at least one first and said at least one second compacting plate. The first compacting plate and the second compacting plate are rigidly connected together by wall means extending therebetween and when the object-support means has the form of a floor means, said floor means may extend between said first and said second plates to terminate at a given distance therefrom to define a respective gap therewith. The compacting unit comprising the first compacting plate, the second compacting plate, the connecting walls and, optionally the floor means may be arranged for reciprocating movement, towards and away from the intermediate, in this case stationary compacting plate. In this case, the unit may be driven by a single prime mover arranged to co-operate with one of the said plates to cause said reciprocating movement. Alternately, a prime move may be arranged to co-operate with each of said first and said second plates.

When objects are to be compacted on a large scale the compacting apparatus may be arranged to receive a relatively large number of objects in random orientation. Since the compacted objects may tend to be held against the sides of respective compacting plates subsequent to a compacting operation by, e.g. frictional forces, means may be provided for initiating the free fall of the compacted objects through said free-fall orifice.

The apparatus may also be used to compact bulk waste, such as domestic waste, sewage tailings or factory waste, e.g. polystyrene waste, to a high-degree of compaction, in which case the free-fall aperture will cooperate with means for automatically closing and opening the aperture at given times during a working operation. Walls provided to contain the waste in the apparatus will have drain means for the egress of liquid, or may be of a strong porous material.

Conveniently a plurality of said single-compacting apparatus or said double-acting compacting apparatus may be arranged in line and/or in side-by-side relationship to form a compacting plant in which the respective compacting apparatus may be arranged to receive objects of the same or similar type, or may be arranged to receive objects for compaction or crushing of differing types.

So that the invention will be more readily understood and optional features thereof made apparent, exemplary embodiments of the invention will now be described with reference to the accompanying schematic drawings, in which:

FIG. 1 is a perspective view, partly in section, of a single compacting apparatus with the movable compacting plate in its starting position;

FIG. 2 is a view similar to that of FIG. 1 with the movable compacting plate in its final compacting position;

Figure 3:
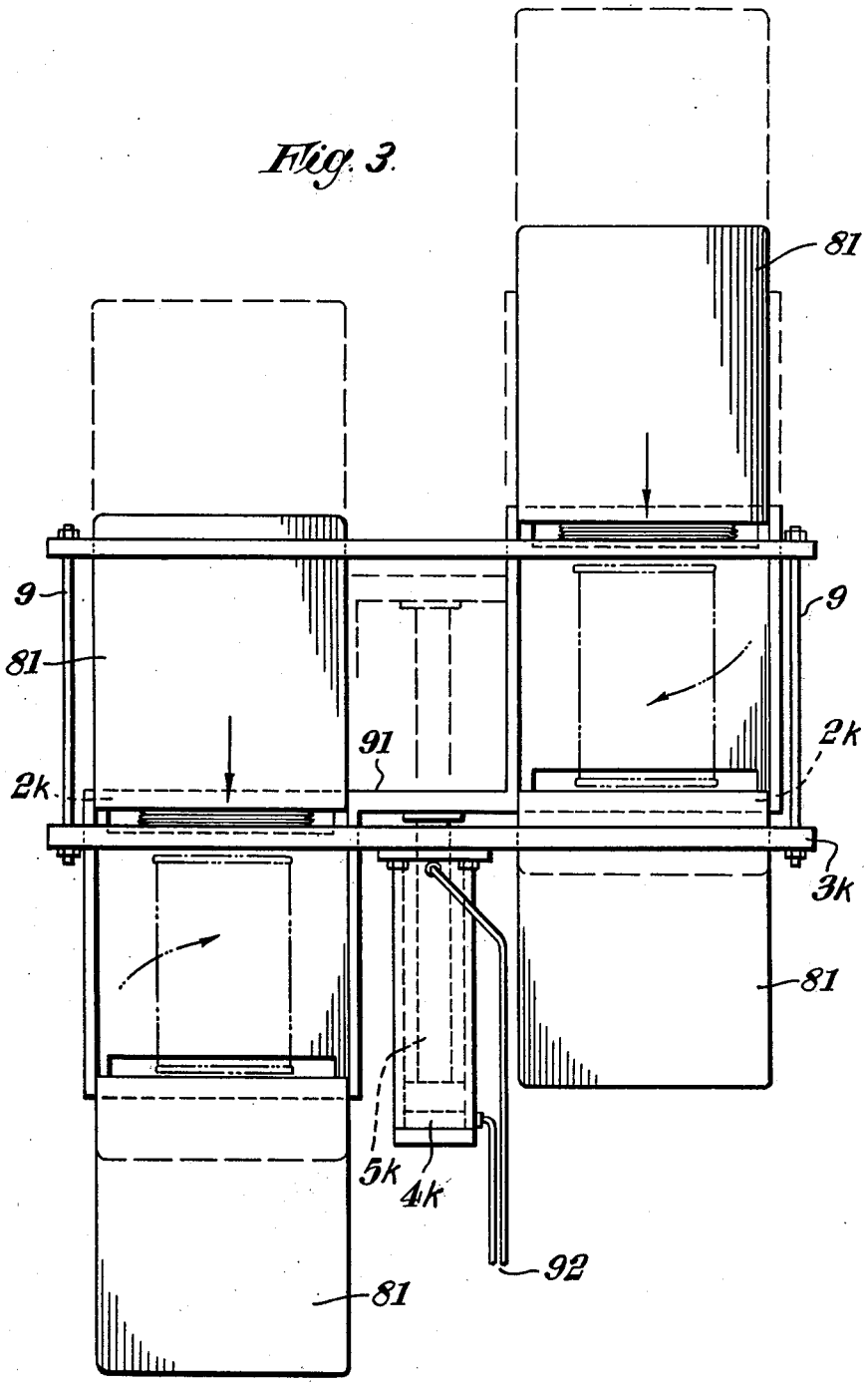
FIG. 3 illustrates diagrammatically the assembly of a plurality of double-acting compacting devices to form a compacting plant.

In FIGS. 1 and 2 there is illustrated a single compacting apparatus comprising a stationary compacting plate 1 and a compaction plate 2 which is arranged for reciprocating movement, towards and away from said stationary plate 1. The stationary compacting plate 1 is rigidly connected by means of ties or wall means 9 to an end wall 3 on which there is mounted a cylinder 4 in which a piston 5 is arranged for axial mov ement. One end of the piston extends through an aperture in the wall 3 and is connected to the movable compacting plate 2 in order to move said plate towards and away from said stationary plate 1. In the illustrated embodiment the movable compacting plate 2 has connected thereto an object-support means in the form of a floor 6 having an elongate free-fall aperture 7 arranged therein adjacent the plate 2. The longitudinal axis of the aperture 7 is parallel with the longitudinal axis of the plate 2, as seen in the Figure, and the length and width of the aperture is determined by the size of the objects to be compacted and the degree of compaction to which they are to be subjected. The stationary compacting plate 1 is provided with a slot 8 through which the floor 6 can pass as the plate 2 approaches the stationary plate 1.

FIG. 2 illustrates the position of the movable plate 2 relative to the stationary plate 1 at the end of a compacting stroke of the piston 5, the floor 6 having passed through slot 8 to an extent such that the aperture 7 is located immediately beneath the compacting object, thereby enabling the compacted object to fall freely through said aperture and away from said apparatus, as illustrated by the compacted can shown in ghost lines.

When compacting, for example, large cylindrical cans or drums, it may be move convenient to compact the cans or drums sideways on, i.e. with a long axis of the can or drum extending parallel to the long axis of the free-fall aperture, thereby reducing the necessary length of working stroke.

Figure 4:
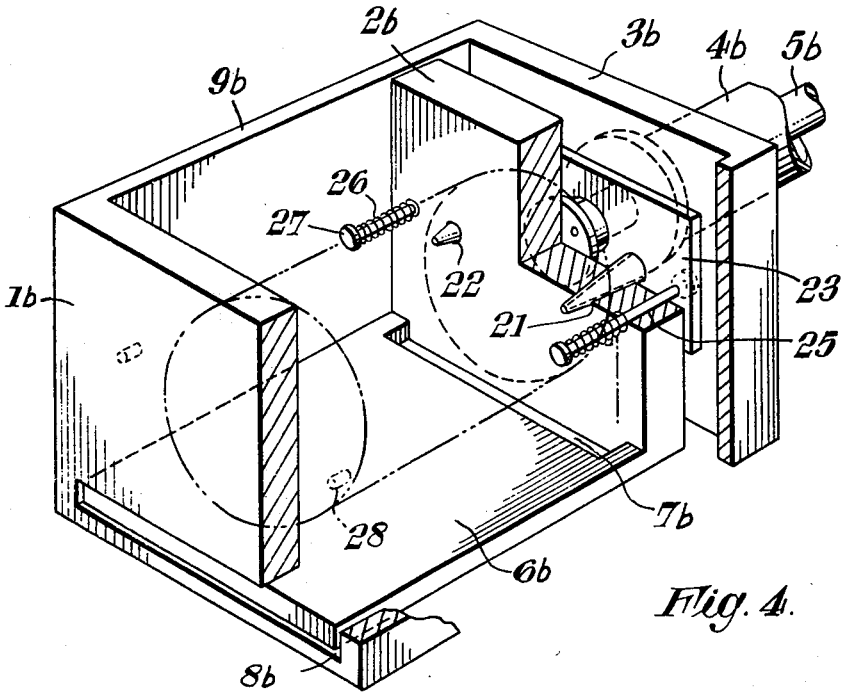
FIG. 4 is a perspective view, partly in section, of one embodiment of a can-piercing device.

FIG. 4 shows an embodiment generally similar to that of FIGS. 1 and 2 and including one embodiment of a can-piercing device mounted, in this case, on the movable plate 2*b*. The illustrated device comprises two spikes 21, each of which is arranged to pass through an opening 22 in the movable plate 2*b* and is connected to a carrier 23. The carrier 23 is connected to the plate 2*b* by means of a respective stud 25 passing therethrough. One end of the stud 25 is fixed to the carrier 23, as by welding for example, while the other end of the stud has mounted thereon a plate 27. Extending, under slight compression, between the plate 27 and the opposing face of plate 2*b* is a coil spring 26 biasing the carrier 23 towards said plate 2*b*. The strength of the spring 26 is sufficient to prevent its associated spike from being displaced axially to any great extent by means of a can being punctured thereby. Arranged on the plate 1 are rods 28, these rods being intended to bear against respective plates 27 as the plate 2*b* moves towards the fixed plate 1 during a compaction operation, the rods pushing against plates 27 to force the carrier 23 away from the plate 2*b*, thereby to withdraw the spikes 21 from the can. The extent to which the springs are compressed will be sufficient to permit the spikes to be fully withdrawn from the can, so that the can is able to fall freely through the free fall aperture.

Figure 5:
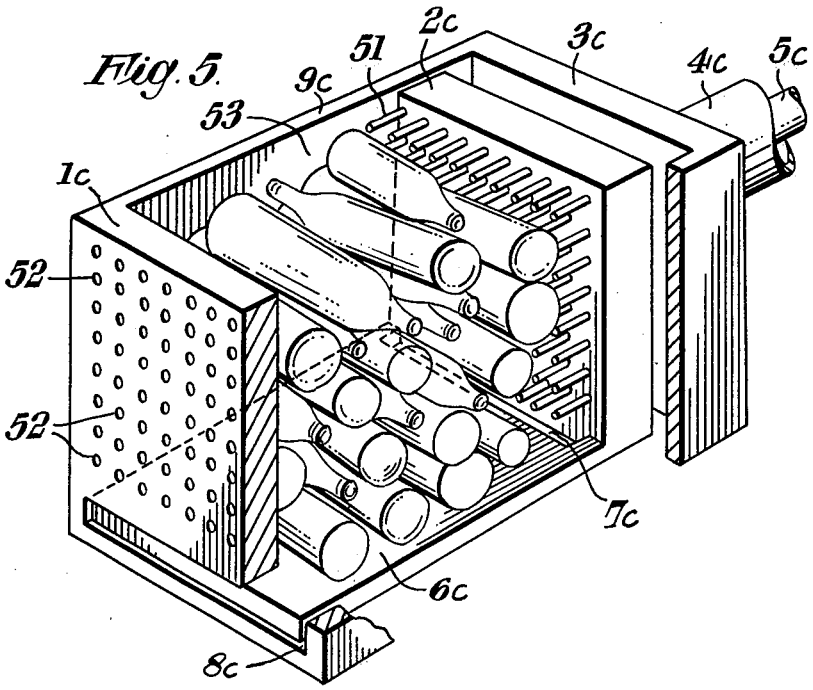
FIG. 5 illustrates the apparatus adapted for crushing bottles or like brittle objects.

FIG. 5 illustrates the manner in which a compacting apparatus according to the invention can be modified to crush bottles and like brittle objects. In this embodiment of the apparatus, the surface of the movable plate 2*c* facing the stationary plate 1*c* has arranged thereon a plurality of pegs 51, each of which is arranged to be received in a corresponding through-hole 52 in the plate 3*c*, during a bottle crushing operation. The bottles, for example, are fed to the feed space 53 and, as the plate 2*c* advances, are crushed against the face of the plate 1*c*, the fragments falling out through the aforementioned free-fall aperture 7*c* into a receptacle provided therefore. Any powdered glass which does not fall into the receptacle, but remains in the apparatus and tends to pack, so as to present an obstacle to the full working stroke of the moving plate 2*c* will be forced by the pegs into and through respective holes 52, to fall away from the apparatus.

The side walls 9, the fixed compaction plate 1*c*, the end wall 3*c* and the floor 6*c* form an open top box-like structure in which the bottles are contained during a crushing operation.

Figure 6:
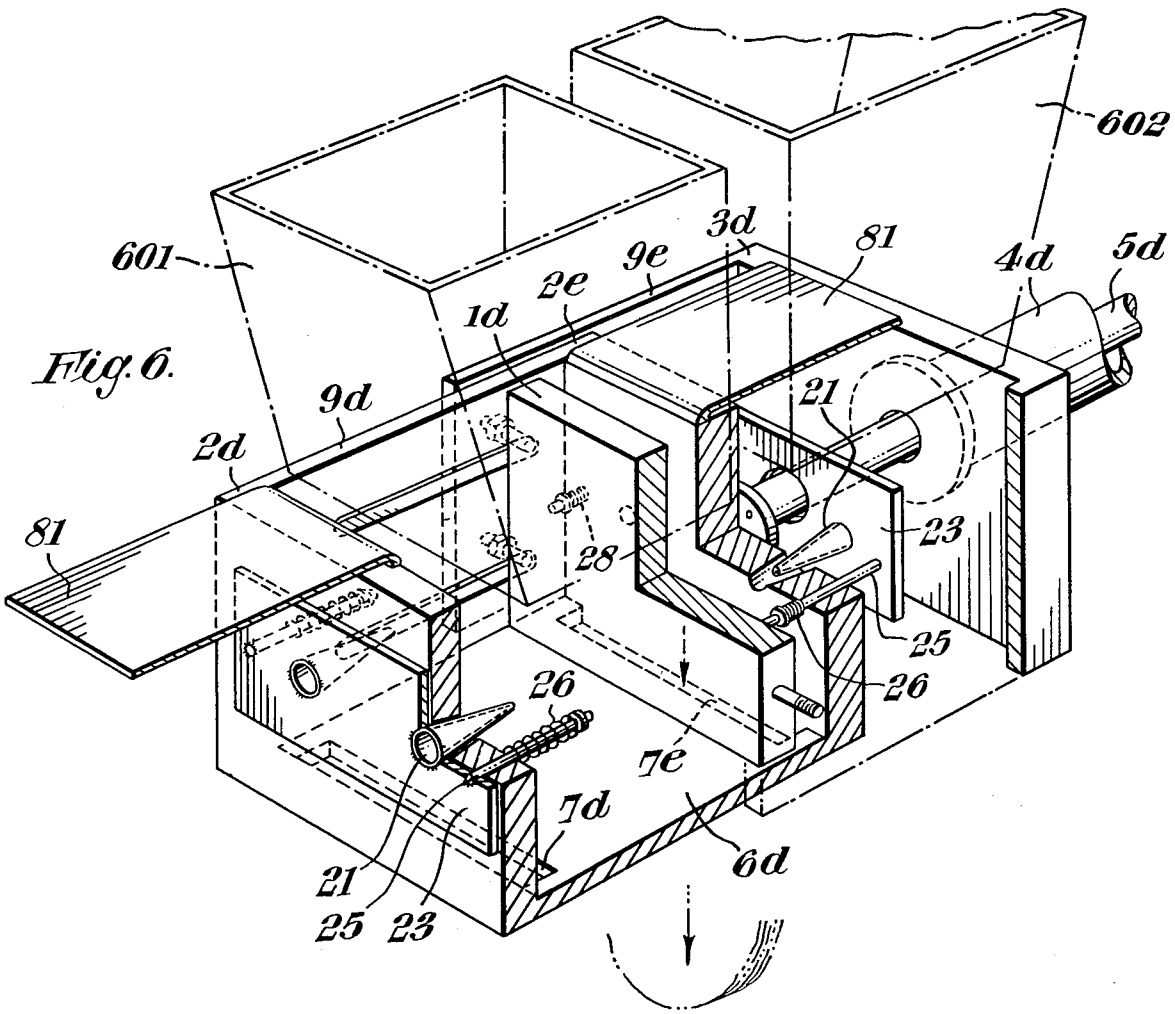
FIG. 6 illustrates two of the apparatus illustrated in FIG. 1 joined in tandem having two spaced apart, movable compacting plates and a stationary compacting plate intermediate of said spaced apart plates and common thereto and can-piercing means.

FIG. 6 illustrates the manner in which two of the aforedescribed compacting apparatus can be joined in tandem to form a double-acting compactor, i.e. an apparatus which will compact in both directions of movement of the movable compacting plates 2*d* and 2*e*. In this embodiment the apparatus comprises two movable compacting plates 2*d* and 2*e* which are rigidly connected in spaced apart relationship by means of ties, which may have the form of side walls 9*d*. Arranged between the two movable plates 2*d* and 2*e* is a stationary compacting plate 1*d* which is connected to an end wall 3*d* spaced therefrom, by means of the ties 9*d*, which may also have the form of side walls. Thus, the movable walls 2*d* and 2*e* together with side walls 9*d* and, when provided, the floor means 6*d* form a rigid movable compacting unit. It will be apparent from the Figure that when joining two of the aforedescribed compacting apparatus to form a tandem, or double-acting compacting apparatus only one stationary compacting plate 1*d* is required, this stationary compacting plate being common to both of the moving plates. The movable compacting unit is driven reciprocatingly by means of a piston-cylinder-arrangement 5d, 4d arranged at one end of the apparatus. In this instance the movable plate shown to the left of the Figure will be pulled towards the stationary plate 1d when the piston 5d is retracted in cylinder 4d, thereby to crush an object between the plates. The piston may be a differential piston or an equal-area piston. The cylinder is sealingly connected to the outer surface of the end wall 3d and is connected to a source of working medium (not shown), as are also the cylinders of the aforedescribed embodiments. As with the single-compacting apparatus described in FIGS. 1 and 2, the apparatus illustrated in FIG. 6 may be provided with a floor extending between As with the aforedescribed embodiment, the object to be compacted can be fed from a feeding device into the respective spaces defined by respective movable walls 2d and 2e and the fixed wall 1d during a compacting operation, automatically by mechanically or electrically operated feeding and timing devices, or may be allowed to fall into said spaces gravitationally. An example of such a feeding device is a holding device having a mouth sufficiently large to accommodate the objects to be compacted, one at a time, and having a long axis extending parallel to the path moved by the compaction plates. In order to prevent said material from falling from a respective holding device whilst the compacting unit is carrying out a compacting stroke with respect to the other feed device, as shown in FIG. 6 and in a modified exploded view in FIG. 7 each of movable plate 2d and 2e has extending outwardly from the top thereof and at an angle thereto a tail 81 against which said object can rest whilst the compacting plate associated with said tail is making a compacting stroke. The tails 81 are also arranged to close the spaces behind a respective compacting plate during a compacting stroke. Thus, as the plate 2e to the right of FIG. 7 is moved towards the fixed plate 1d its tail 81 will be moved across the mouth of the holding device, to prevent an object held therein from falling into the space between the opposing faces of the movable plate 2e and the end plate 3d.

Figure 7:
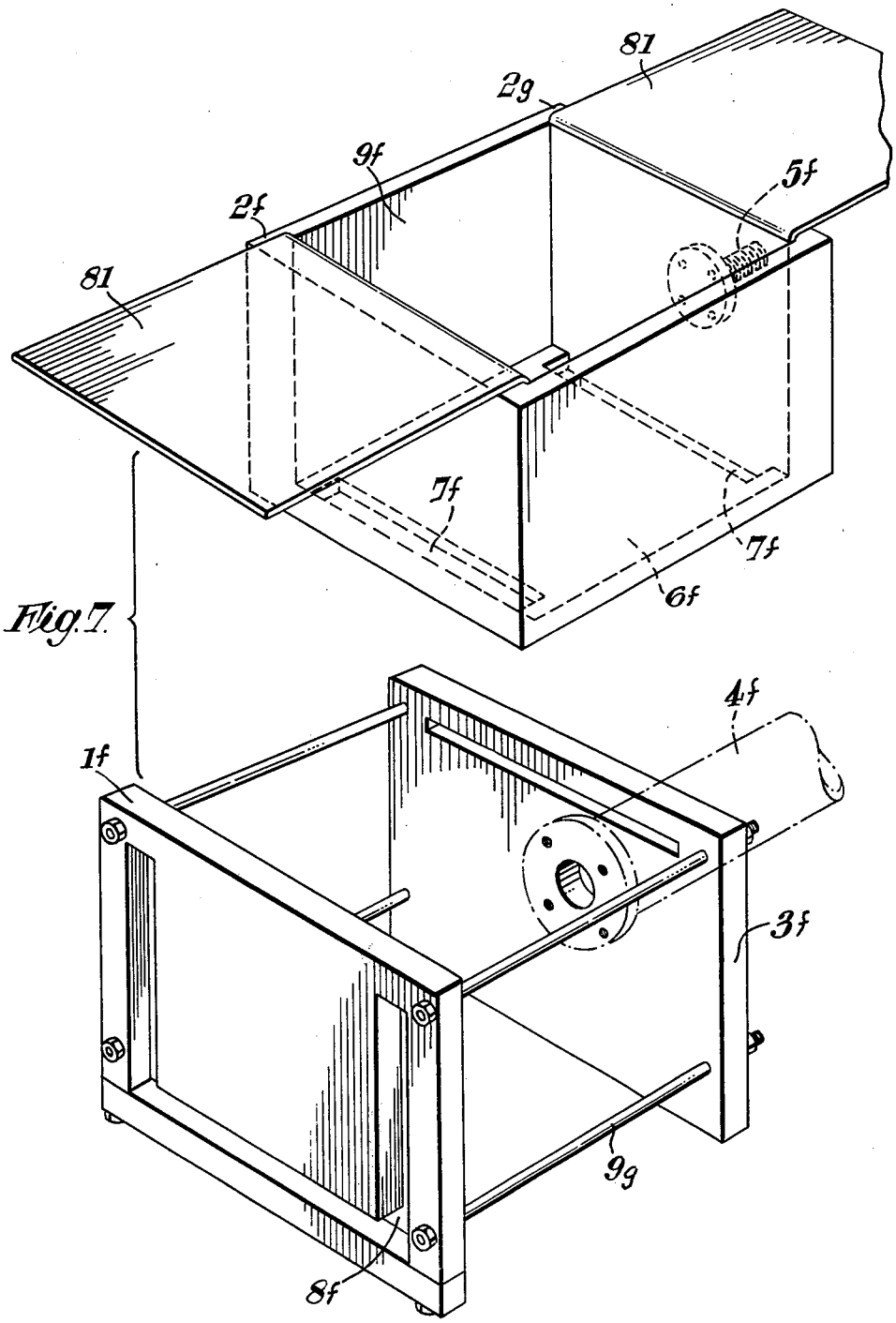
FIG. 7 is an exploded view of the apparatus illustrated in FIG. 6 with the can-piercing means and end-cover removing means not included.

FIG. 7 is an exploded view of a tandem compacting apparatus having a movable compacting unit comprising movable compacting plates 2f and 2g, a floor 6f and walls 9f, the floor 6f having arranged therein adjacent each of said plates 2f and 1g a free-fall aperture 7f. The intermediate stationary plate 1f is rigidly connected to the end wall 3f by means of ties 9g. Arranged in the stationary plate 1f is a U-shaped slot 8f, enabling the walls of the movable compacting unit and, when fitted, the floor 6f to slide through said stationary plate. However, the movable unit may be of a size which enables it to move outside the fixed plate 1f.

As indicated in FIG. 6, each of the movable walls may be provided with a can piercing arrangement, such as that illustrated in FIG. 4.

Figure 8:
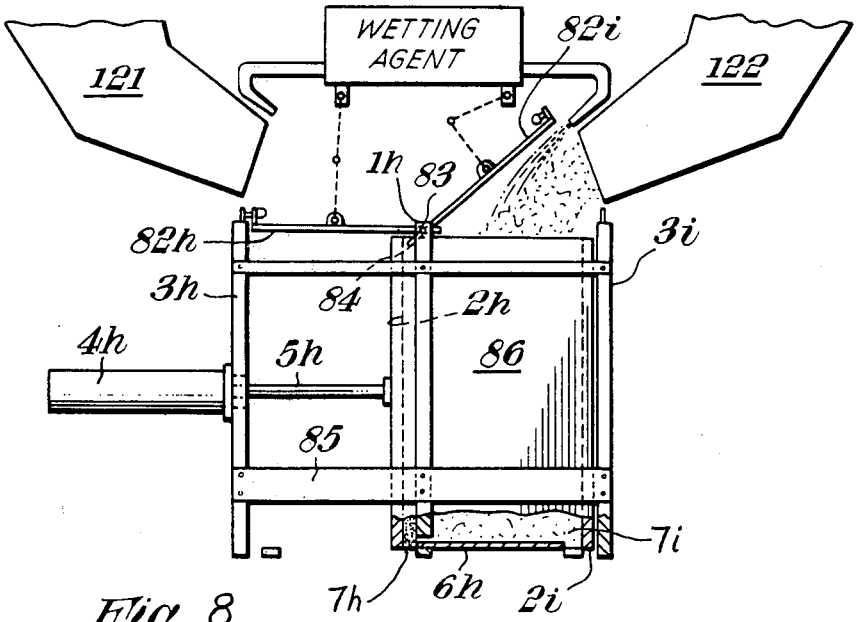
FIG. 8 illustrates an apparatus for compacting a plurality of objects charged to the apparatus in random array.

In FIG. 8 there is illustrated a double-acting or tandem compacting apparatus intended for the in situ compaction of a large number of cans or the compaction of a mass of material such as sewage tailings, domestic waste, factory waste and like waste bulk material. The apparatus comprises a movable compacting unit having two spaced apart movable plates 2h and 2i tied together by means of ties (not shown) and floor means 6h with free-fall apertures 7h and 7i arranged therein, in the manner of the compacting apparatus hereinbefore described. The apparatus further comprises a stationary compacting unit, having a fixed compacting plate 1h which is spaced from and tied to a fixed end wall 3h. Sealingly connected to the end wall 3h is cylinder 4h of a piston-cylinder-arrangement, one end of the piston 5h of said arrangement being connected to movable plate 2h. Side walls 86 are provided to contain material to be compacted within respective compaction spaces. These walls extend between the movable plates 2 in a manner suitable to form an open-top box-like structure into which the material to be compacted can be charged, the height of the side walls depending upon the material to be compacted and, when the material will contain water, are provided with drainage means or are made of a strong, porous material. Preferably, the side walls will have the same height as the compacting plates. The unit comprising plates 2h and 2i and side walls 86 is preferably arranged to move within the fixed unit formed by plates 1h and 3i and 3ih with the plates 1h between the movable plates 2h and 2i. There is nothing to prevent the unit from moving outside the fixed plate, however, with the walls 86 sliding against the outer edges of the fixed plate 1h.

As shown, each of the loading spaces formed as respective plates 2h and 2i move towards and away from the fixed plate 1h is covered by one of hinged lid 82h and 82i. Each of the lids is pivotable about a common pivot axis 83 arranged in the neighbourhood of the top of the plate 1h and has a release portion 84 which extends across the stationary plate, to protrude into the space covered by the other of said lids. To facilitate pivoting of respective lids about the common pivot axis 83, the pivot edges of respective lids adjacent said axis are provided with tongues and apertures which are received in and which receive respectively similar tongues and apertures arranged in the pivot edge of the other of the lids, the tongues of respective lids forming said protruding release portions. As with the embodiments described above, the floor 6h will be provided with free-fall aperture means arranged in a manner such as to be located beneath the compacted material at the end of a compacting stroke.

When the material to be compacted is dry and not readily compactable, a wetting agent may be added, which reduces the resistance to compaction, said agent being optionally mixed with a binder. one direction e.g. towards the respective fixed plates, and the other movable plates away from said fixed plates. When the compacting apparatus are also joined in-line, i.e. arranged one behind the other, the movable plates of one apparatus are rigidly connected to the movable plates of the next apparatus in line, so that all said plates move in unison, with movement of the said common bar or beam.

Such an arrangement is shown schematically in FIG. 9, in which two apparatus joined together are shown. The prime mover of the illustrated embodiment is a piston-cylinder-arrangement, the cylinder 4k of which is connected to an extended end-wall means 3k extending transversally of the apparatus. The free end of the piston 5k is connected to a beam 91 which is connected in turn to each of the movable plates 2k such that movement of said beam will cause corresponding movement of respective plates 2k. Reference 92 shows the supply lines for working medium to the piston-cylinder arrangement 4k, and 5k.

I claim:

1. A compacting apparatus comprising a first compacting plate;

a second compacting plate;

means for mounting said second compacting plate for reciprocating movement relative to said first compacting plate;

movement means for providing said relative movement;

means defining a free-fall aperture between said first and second plates and adjacent one of said plates; and means for supporting material to be compacted, at least during the initial stage of a compacting operation, said support means for supporting including a floor means extending from one of said plates and being arranged for movement beyond the other of said plates, said floor means having arranged therein said free-fall aperture such that in the full compacting position of said plate said aperture lies beneath the compacted material.

2. A compacting apparatus as claimed in claim 1, wherein said movement means comprises a piston-and-cylinder arrangement adapted to co-operate with the movable one of said plates.

3. An apparatus as claimed in claim 1 in which the material to be compacted is a liquid-filled can, wherein one of said plates is provided with retractable can-piercing means.

4. An apparatus as claimed in claim 3, wherein the can-piercing means comprises a spring-biased piercing member retractably mounted on said one of said plates.

5. An apparatus as claimed in any one of claims 1 or 2 wherein said plates are provided with means for crushing brittle material.

6. An apparatus as claimed in claim 5, wherein said crushing means comprises a plurality of pegs arranged on the surface of the movable plate facing the stationary plate and adapted to be received in respective through-holes disposed in said stationary plate.

7. An apparatus according to claim 1 and further comprising a third compacting plate;

means for attaching said third compacting plate to said second compacting plate for movement therewith with said first compacting plate lying between said second and third compacting plates;

means defining a second free-fall aperture between said first and third plates and adjacent one of said plates; and second means for supporting material to be compacted between said first and third plates, at least during the initial stage of a compacting operation, said second means for supporting including a floor means extending from one of said first and third plates and being arranged for movement beyond the other of said plates, said floor means having arranged therein said second free-fall aperture such that in the full compacting position of said third plate said aperture lies beneath the compacted material.

8. An apparatus according to claim 7 and further comprising an end plate mounted on the opposite side of one of said second and third plates from said first plate, said end plate being rigidly connected to said first plate.

9. An apparatus as claimed in claim 7, wherein said apparatus comprises feed means for feeding objects to be compacted alternately to the respective spaces formed between respective ones of said second and said third compacting plates with said first compacting plate during said relative movement.

10. An apparatus as claimed in claim 9, wherein each of said plates has extending outwardly from the top thereof and at an angle thereto a support surface against which an object fed from said feed means is able to rest in readiness to be fed to a respective one of said spaces.

11. An apparatus as claimed in claim 7 wherein pivotable lid means are provided for covering the loading space or spaces formed during a working stroke of the apparatus, said pivotable lid means having means thereon for initiating the free fall of compacted material through an associated free fall aperture.

12. An apparatus as claimed in claim 11 wherein said lid means are pivotable about a common axis located on the top edge of said stationary compacting plate and extending substantially parallel with said top edge, and wherein the edges of said lid means adjacent said common axis protrude into a respective one of the adjacent loading spaces in a manner such as to be pivotable about said axis and wherein said protruding portions of said lid ends form said free-fall initiating means.

13. An apparatus as claimed in claim 12 in which the material to be compacted is not readily compactable, dry bulk waste material, wherein means are provided for wetting said material with a substance to facilitate the compaction thereof.

14. An apparatus as claimed in claim 13, wherein the wetting agent is a water-bound adhesive.

* * * * *